US007764187B2

(12) United States Patent
Gai et al.

(10) Patent No.: US 7,764,187 B2
(45) Date of Patent: Jul. 27, 2010

(54) ANTI-CORROSION CATHODIC PROTECTION DEVICE WITH SACRIFICIAL ANODE

(75) Inventors: Giorgio Gai, Genoa (IT); Staiolo Alessandro, Ronco Scrivia (IT)

(73) Assignee: Ultraflex S.p.A., Casella (GE) (IT)

( * ) Notice: Subject to any disclaimer, the term of this patent is extended or adjusted under 35 U.S.C. 154(b) by 496 days.

(21) Appl. No.: 11/839,574

(22) Filed: Aug. 16, 2007

(65) Prior Publication Data

US 2008/0042860 A1 Feb. 21, 2008

(30) Foreign Application Priority Data

Aug. 16, 2006 (IT) ..... SV2006A0023

(51) Int. Cl.
*G08B 21/00* (2006.01)

(52) U.S. Cl. ..... 340/635; 340/640; 340/547; 340/609; 340/636.14; 340/691.1; 204/404; 204/196.06; 204/196.38; 324/71.2; 324/700

(58) Field of Classification Search ..... 340/635, 340/609, 636.14, 540, 547, 691.1; 204/404, 204/196.06, 196.38; 324/71.2, 700
See application file for complete search history.

(56) References Cited

U.S. PATENT DOCUMENTS 4,051,007 A * 9/1977 Hossle ..... 204/196.07
6,932,891 B2 * 8/2005 Wigg et al. ..... 204/196.06

FOREIGN PATENT DOCUMENTS

DE 3000944 A1 7/1981

OTHER PUBLICATIONS

European Search Report, Nov. 2, 2009.

* cited by examiner

*Primary Examiner*—Tai T Nguyen
(74) *Attorney, Agent, or Firm*—Themis Law

(57) ABSTRACT

A cathodic protection device having a sacrificial anode that is intended to wear out due to corrosion and that is electrically connected to a structure to be protected against corrosion. The cathodic protection device of the present invention further includes an indication device configured to detect and indicate the wear of the sacrificial anode wirelessly, without the use of cables.

25 Claims, 5 Drawing Sheets

ANTI-CORROSION CATHODIC PROTECTION DEVICE WITH SACRIFICIAL ANODE

FIELD OF THE INVENTION

The present invention relates to an anti-corrosion cathodic protection device with a sacrificial anode. More particularly, the present invention relates to an anti-corrosion cathodic protection device with sacrificial anode that provides an indication of the wear of the sacrificial anode.

BACKGROUND OF THE INVENTION

Anti-corrosion cathodic protection devices having sacrificial anodes are known and widely used. Although such devices serve their intended purpose, anti-corrosion cathodic protection devices having sacrificial anode in the prior art exhibit some drawbacks.

Metal structures to be protected against corrosion, particularly maritime or nautical structures are generally placed in locations that can be hardly reached or that are difficult to reach due to the limited space available on boats.

In particular, the immersed portions of boats need to be protected against corrosion, for example, portions of the keel, propellers, the rudder and particularly transverse operating maneuvering propellers, so called bow thrusters.

Since propellers, particularly bow thrusters, are immersed in water for all the time the boat is on water, propellers must be provided with a level of corrosion protection that is effective, inexpensive and easy for maintenance. Typically, the protection employed is cathodic, wherein corrosion that may attack a structure attacks instead an anode, rather than attacking the structure. The anode is typically (but not exclusively) made of zinc, which, due to a known electrochemical reaction, is corroded instead of the structure to be protected. The anode is called "sacrificial anode" in jargon, since it is designed to be worn out because of the electrochemical reaction, preventing corrosion of the structure to which the anode is electrically connected thereto.

Once the sacrificial anode is worn out, it is replaced, protecting the structure from new corrosive attacks. The anode must be timely replaced, especially for immersed structures, such as propellers or the like, in order to prevent a corrosive attack on the structure, and a related weakening of the structure.

Consequently, the wear condition of the sacrificial anode must be verified periodically, in order to identify the wear state of the anode before the cathodic protection device stops operating due to dissolution of the anode.

An important drawback in addition to what described above is that the corrosion rate, and, therefore, the time needed for replacement, changes according to a number of elements, so it is necessary to frequently inspect or monitor the wear condition of the anode. Consequently, it is hardly possible to forecast when the anode will have to be replaced, but on the contrary the anode must be frequently inspected, or must be replaced before necessary.

Replacing the anode too early, that is, when it is not worn out yet, is not a preferred solution, since the anode is not completely used and costs are increased by replacing an anode that is still operating, even for a relatively short time.

Solutions in prior art have been provided for monitoring anode wear state, for example by measuring the electric current flowing in the anode by means of wires electrically connecting the anode to a measurement device.

Therefore, in order to have information about the state of anode wear state, either anode wear must be verified by visual inspection or a cable connection must be provided between the anode and the measurement device.

In general, but particularly for bow thrusters or maneuvering propellers, or more generally for the immersed structures of a boat, or for a fixed installation, inspection is often complex and also expensive. Trained personnel must dive and monitor the wear condition of the anode for ascertaining whether corrosion or wear has cause the anode to be replaced. This situation causes a considerable waste of time and money, and at the same time does not guarantee a timely replacement of the anode when it is corroded to the point that it can no longer perform its function. The owner of a boat or the captain must provide the time, equipment and knowledge necessary for diving and for checking the wear or use or corrosion conditions of the anode, or specialized personnel must be trained for such job, involving high costs.

On the contrary, if the condition of the anode is verified by using a cable monitoring system according to the prior art, for example by an electrical measurement, additional problems must be considered. For example, a wire must be provided, which contacts the marine or submarine environment, for connecting the anode with the measurement device. The cable, or wire, must be insulated from water, especially if the monitoring function requires the use of electricity, and the cable or wire itself is subjected to corrosion because of the marine environment, causing the wire to become worn, corroded or oxidized, so that it cannot appropriately carry out the monitoring function it has been designed for.

Moreover, monitoring through a cable requires that the operating conditions of the monitoring device be checked regularly, in order to insure proper operation. A malfunctioning of the monitoring device can cause no generation of a signal indicating a corroded anode, thus parts of the structure to be protected by the sacrificial anode become exposed to corrosion. As an alternative, the device monitoring the anode corrosion may indicate a malfunction, but this requires trained personnel to monitor and maintain the monitoring device, causing undesired costs and expenditures of time. On the other hand, it is well known that the marine environment attacks particularly immersed devices, and so a malfunction may be expected when using a cable, or a wire monitoring function.

BRIEF SUMMARY OF THE INVENTION

It is an object of the present invention is to provide a cathodic protection device having a sacrificial anode that includes a sacrificial anode to be worn out due to corrosion and that is electrically connected to a structure to be protected from corrosion while the drawbacks of cathodic protection devices in the prior art are overcome simply and inexpensively.

The present invention achieves the above object by providing a cathodic protection device having a sacrificial anode, and further having an indication device that detects and indicates the wear of the sacrificial anode without using cables but using a wireless system. Providing a device that indicates the wear of the sacrificial anode without using cables but instead a wireless system solves the above described drawbacks in prior art devices.

The device according to the present invention enables a user to receive an indication of the state of wear or erosion or corrosion of the anode without employing a cable monitoring or indication system, and without visually monitoring the anode condition.

A monitoring system that employs no cables but instead a wireless system provides for a device that indicates the state of wear of the sacrificial anode and parts thereof and that is optimally insulated from the environment in which the anode is necessarily immersed, and also provides for various parts of the monitoring system to be optimally insulated, allowing operation of the system without a frequent maintenance.

Examples of wireless systems, or, more generally, of systems using no cables are the READ relay, radiofrequency devices, Bluetooth, ZIG-BEE devices, all known to a person skilled in the art as wireless devices intended to transmit/receive one or a series of data, or as an alternative or in combination, other type of proprietary systems may be used.

According to one embodiment, the indication device is divided into a first indication device portion removably coupled to the sacrificial anode, and a second device portion fixed with respect to the sacrificial anode. The first device portion can be uncoupled and released from the sacrificial anode at a predetermined wear or corrosion level of the sacrificial anode, and the second device portion detects when such level is achieved by monitoring the presence/absence of the first device portion.

For example, READ relays are simple and inexpensive types of relays having a metal sheet in a position that closes an electrical contact by the presence of a magnetic field. In one embodiment, the first device portion is a permanent magnet and the second device portion is a READ relay, and once the magnet is uncoupled from the anode and is released in the outer environment, the magnetic field acting on the metal sheet of the READ relay is extinguished. Therefore, the metal sheet of the relay moves in the position that opens the electrical contact, thus generating a signal about the absence of the magnet.

In this embodiment, the presence/absence is detected of an element that is removably coupled to the sacrificial anode and that becomes is uncoupled, or released, or anyways freed from the anode at a predetermined wear level of the anode.

This embodiment provides, in a simple and easy manner, for a predetermined wear level to be reached and indicates such wear level to the user, so he can plan for the replacement of the sacrificial anode.

This kind of solution overcomes one more prior art drawback, that cable devices often emit wrong signals and do not correctly detect the level of corrosion or erosion of the sacrificial anode because the device contacting the marine environment is subjected to oxidation, and/or because of the damage to the insulation of the cable or device. On the contrary, using the device according to the present embodiment, in which the first device portion is uncoupled and released from the sacrificial anode at a predetermined wear or corrosion level, particularly when the release occurs through a mechanical release, no mistakes can occur in detecting the erosion or wear or corrosion level of the anode.

More particularly, the presence or absence of the first device portion is checked by the second device portion through a wireless magnetic connection, for example through the above discussed READ relay or the like.

A magnet or more generally a magnetic member or a member intended to be detected by a magnetic sensor can be inserted inside the anode, providing the first device portion that is released or uncoupled from the anode when the anode reaches a specific wear level.

For example, the magnet or more generally the magnetic member or the member intended to be detected by magnetic sensors may be secured to the anode in a recess or hollow space provided inside the anode. That recess is closed until the anode reaches a specific wear level and becomes an open or uncovered recess when a specific wear level of the anode is reached, thus allowing the magnet or more generally the first device portion to be discharged or to be mechanically uncoupled from the anode.

Therefore, the first device portion is composed at least partially of a magnetic element removably situated inside a housing recess provided in the anode, and the second device portion includes a detection circuit.

The housing recess provides inside said anode is a blind or closed recess when the wear or corrosion of the anode is lower than a predetermined value, and it opens, to be an open recess, when the wear or corrosion of the anode is equal to or greater than a predetermined level.

Thus, by providing a device according to the present embodiment, a cathodic protection is achieved which can be safely monitored, and which is inexpensive and designed for easy maintenance.

Because the first device portion is released in the outer environment by a mechanical release causes the typical oxidation of marine environment not to be a problem, overcoming drawbacks of prior art devices.

Wireless transmission may also be provided by a battery powered electronic chip, composing the first device portion, which transmits a presence signal to a receiver, composing the second device portion, for example by a radiofrequency transmission on free and usable frequencies.

As an alternative, the first and second portions can be composed of a device known as Bluetooth, or of other devices known to a person skilled in the art, for example, ZIG-BEE, that periodically, for example at predetermined time intervals, checks the presence/absence of the first device portion by radio waves.

Custom or proprietary wireless standards may also be created and employed to achieve the present objective.

According to an embodiment of the invention, a device according to the present invention may be mounted at the base of a transverse operating maneuvering propeller, particularly at the base portion opposite to the portion supporting the propeller. Such position of the device is very useful and advantageous, allowing for the structure to be considerably protected and for a simple replacement of the sacrificial anode when needed.

Moreover, when a device according to the present invention is situated in the area of the base of the propeller opposite to the area supporting the propeller, a considerable safety may be attained during replacement of the anode, because the anode is near the propeller but in an area opposite to the base supporting anode and propeller.

IN one embodiment, the anode is coupled to the structure by a fastener, preferably a screw, so that the anode is replaced only through a simple action that can be performed quickly and with limited labor costs. When an excessive wear of the sacrificial anode is detected by a detection circuit according to the present invention, the fastener may be disassembled, uncoupling the residual portion of the anode from its location and replacing it with a new anode.

In one embodiment of to the present invention, a retainer may also be provided, for example an O-ring, preferably a metal O-ring, to connect the base of the anode with the neighboring structure, in order to keep the anode in place.

If the anode wears or corrodes about the retainer, electrical contact between anode and structure will not be optimal, causing a reduced cathodic protection. The retainer acts to both physically retain the anode and to provide for an optimal electrical contact between the anode and the structure, guaranteeing an effective cathodic protection.

BRIEF DESCRIPTION OF THE FIGURES

The above described and other characteristics and advantages of the present invention will be more apparent from the following description of some embodiments shown in enclosed drawings, in which.

DETAILED DESCRIPTION OF EMBODIMENTS OF THE INVENTION

Figure 1:
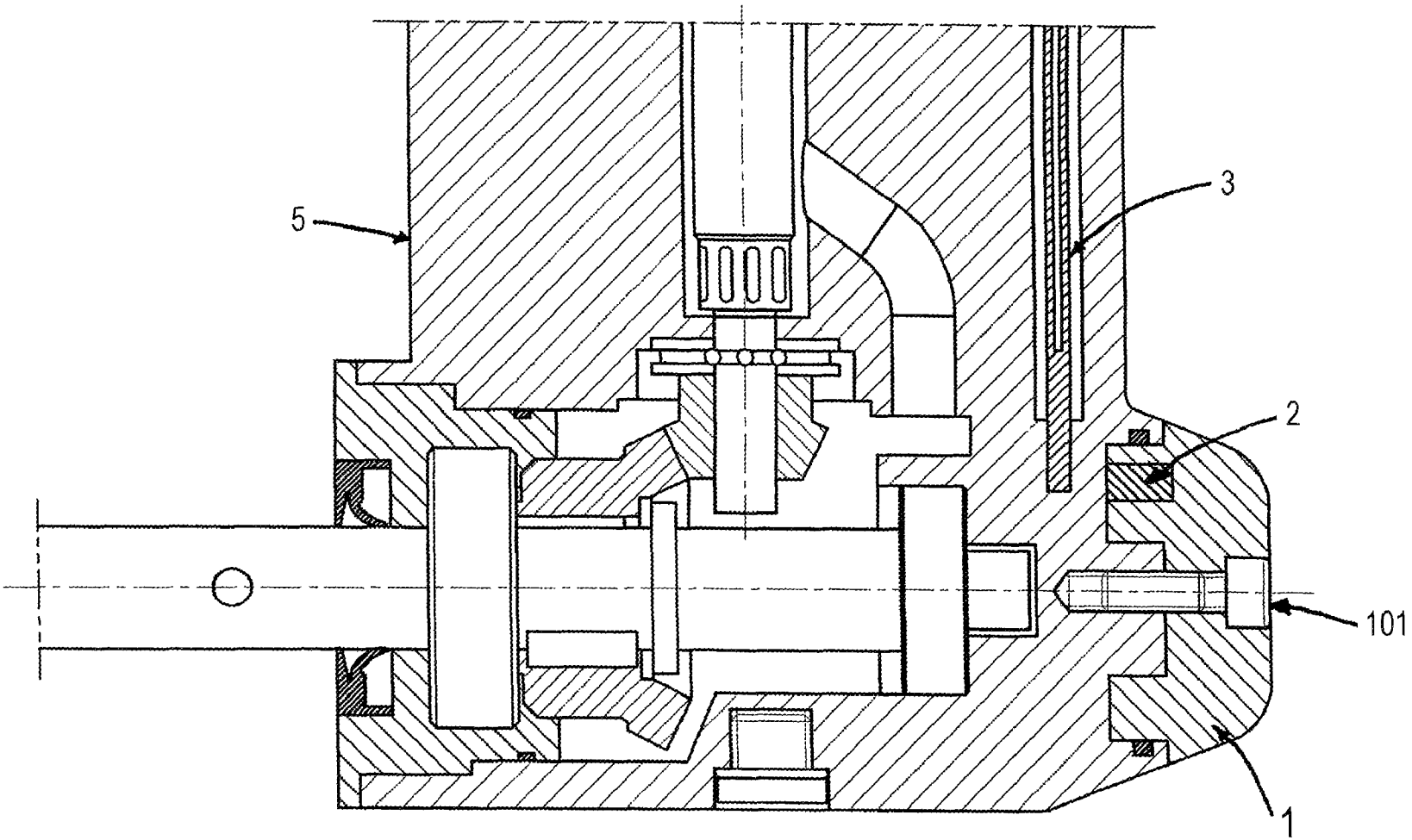
FIG. 1 is a sectional view of a device according to an embodiment of the present invention.
Figure 2:
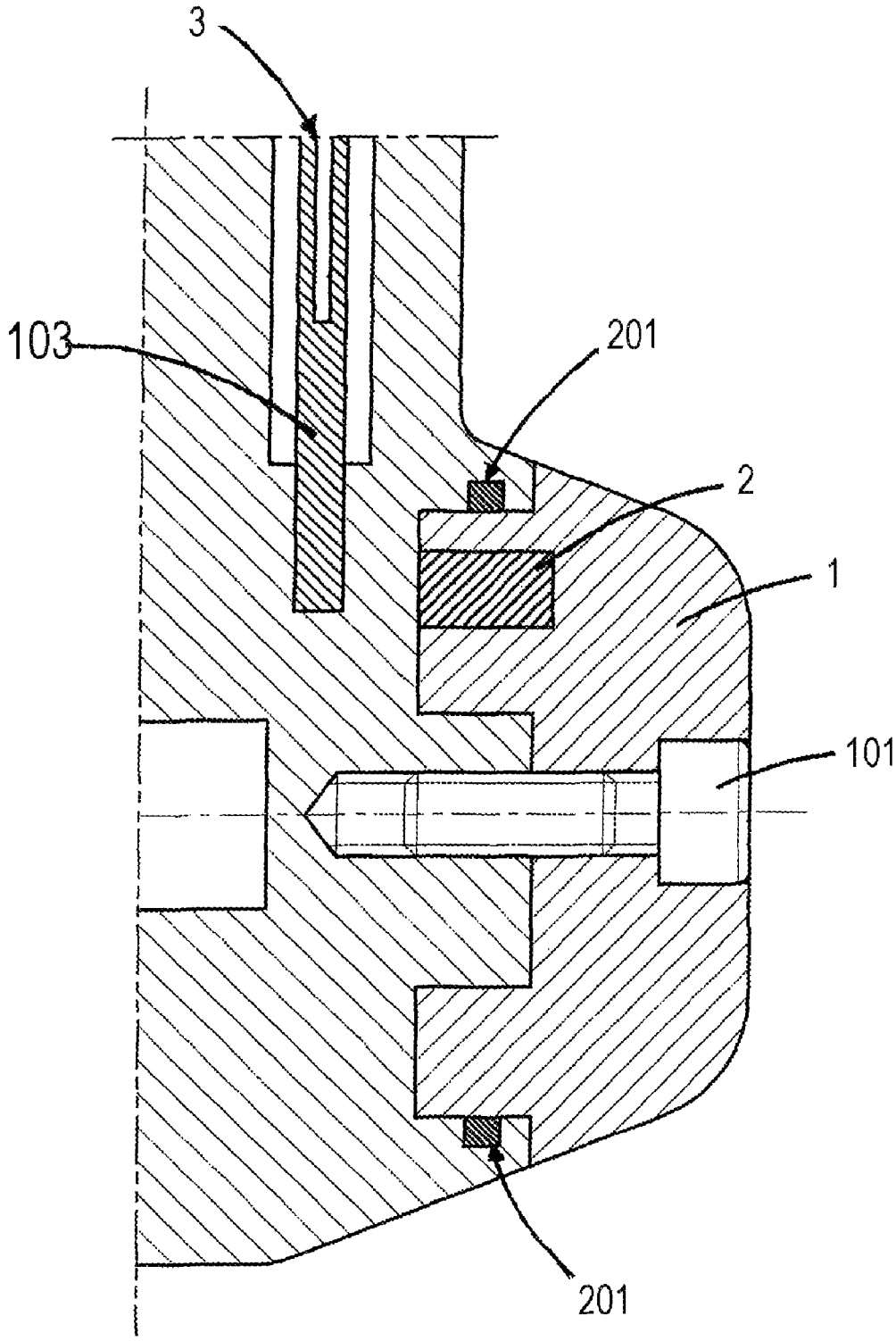
FIG. 2 is a sectional view of a detail of FIG. 1.

FIG. 1 depicts a cross-section of a cathodic protection device with sacrificial anode according to an embodiment of the present invention, in which a sacrificial anode 1 designed to wear out due to corrosion is electrically connected to a structure 5 to be protected from corrosion. An indication device for detecting and indicating the level of wear of sacrificial anode 1 is also included, which communicates without cable, or wirelessly.

The indication device is divided into a first indication device portion 2, removably coupled to sacrificial anode 1, and a second indication device portion 3 in fixed position with respect to sacrificial anode 1.

First device portion 2 is intended to be uncoupled and released from sacrificial anode 1 at a predetermined wear or corrosion level of sacrificial anode 1, and such level is detected by second device portion 3 by verifying the presence or absence of first device portion 2.

Figure 3:
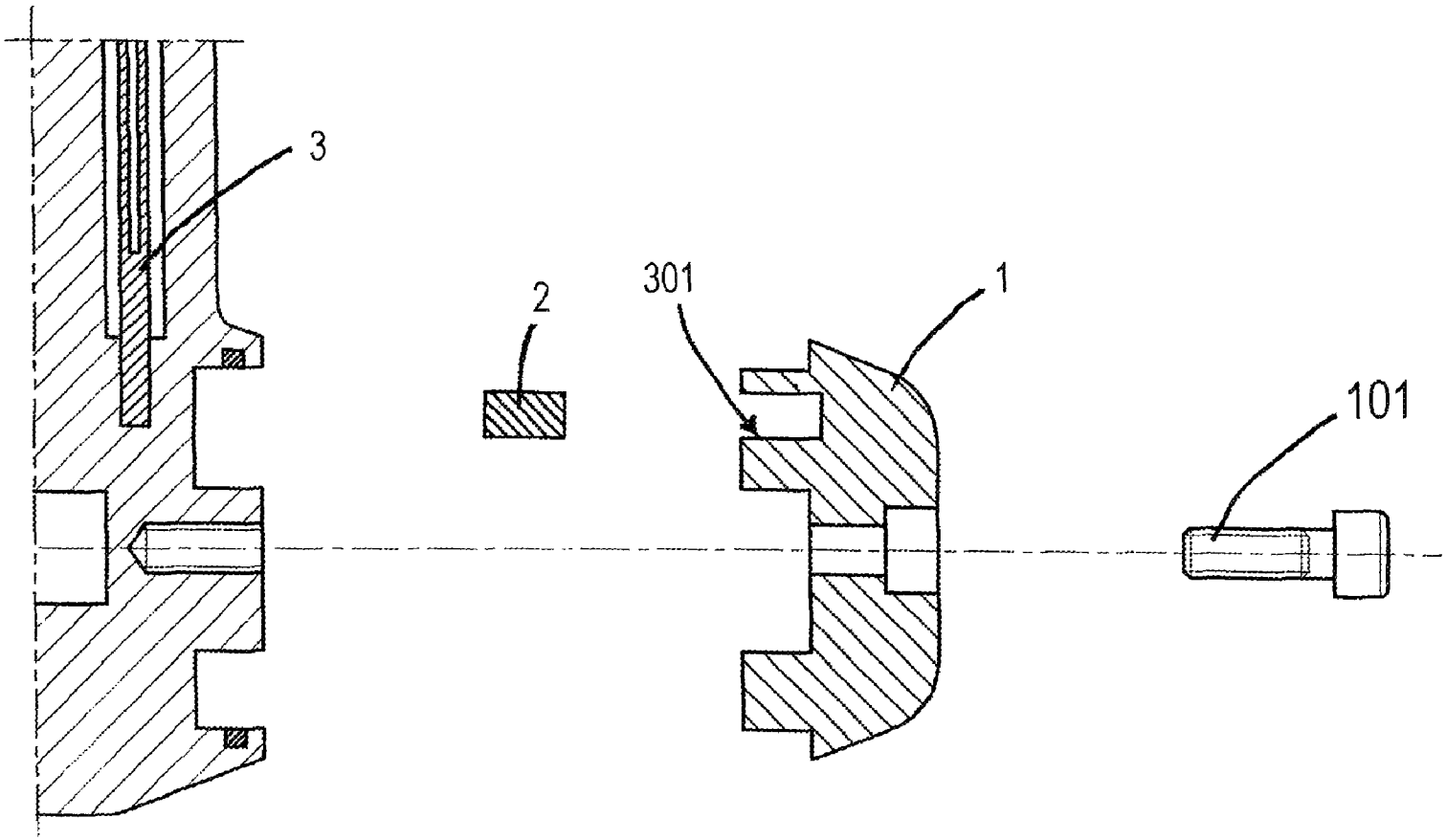
FIG. 3 is an exploded view of the device according to an embodiment of the present invention.

With further reference to FIG. 3, in one embodiment of the invention first device portion 2 is housed into a housing recess 301, which is a closed or blind recess when the wear or corrosion of said anode is lower than a predetermined level, and opens, like an open recess, when the wear or corrosion of sacrificial anode 1 is equal to or greater than a predetermined value.

Figure 4:
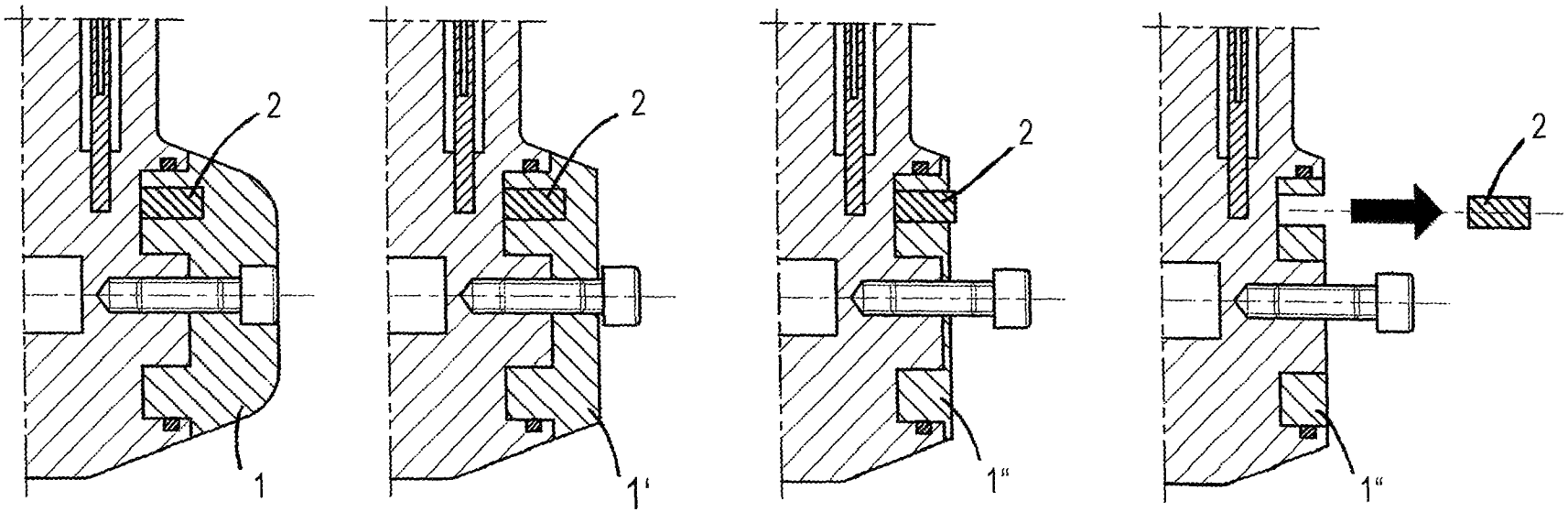
FIG. 4 depicts how the magnet may be released from the anode when the anode is worn out.

FIG. 4 illustrates the basic steps by which the recess becomes open. As shown from left to right, in a first step anode 1 is not worn out and the first indication device portion 2 (for example, a magnet) is housed inside the recess that is outwardly closed. In a second step, anode 1' is wearing out, but the wear of anode is lower than a predetermined threshold wear, and magnet 2 is still situated inside the housing recess, which is still outwardly closed. In a third step, the wear of anode 1" is equal to the predetermined threshold value. Now the wear of the anode 1" causes the recess housing the magnet to become uncovered, allowing magnet 2 to be released, as shown in the far right portion of FIG. 4.

Upon the opening of the housing recess magnet 2 is released from the housing recess for mechanical reasons, typically because of its weight.

The absence of the magnet is detected by second device portion 3 wirelessly, for example by Hall Effect, and anyways without the use of cables.

In general, first indication device portion 1, preferably but not exclusively a magnet 2, is removably coupled to sacrificial anode 1, for example, is housed in recess 301 and it is uncoupled and released from sacrificial anode 1 at a predetermined wear or corrosion level of sacrificial anode 1, which corresponds to the level of wear that causes the originally closed housing recess to open. The level of wear is detected by second device portion 3 by checking the presence or absence of first device portion 2.

Thus, wear or corrosion or erosion of sacrificial anode may be monitored, and sacrificial anode 1 may be replaced only when it is truly necessary, thereby actually overcoming in a simple and inexpensive manner previously discussed drawbacks of the prior art.

Moreover, a wireless monitoring, that is, without the use of cables or wires, enables a simple manufacture and installation process, together with providing a strength of the system that is not achieved with prior art devices.

The device of the present embodiment is provided with at least a fastener 101 for coupling sacrificial anode 1 to structure 5, as shown in FIGS. 1-4, in order to make installation easier.

Preferably, fastener 101 is a screw placed in an intermediate position with respect to the lateral extension of anode 1, further causing installation to be easier.

In order to improve the electrical contact between anode 1 and structure 5, and in order to keep anode 1 in place, even when wear level is high but still lower than the threshold value, a retainer 201 is provided for keeping anode 1 in place. In one embodiment, retainer 201 is a peripheral retainer, intended to engage anode 1 by an interference fit, such as compressing it against structure 5, and it is made of an electrically conductive material and shaped like an annular member extending along at least a peripheral edge of anode 1.

In one embodiment, sacrificial anode 1 is placed at the base of a transverse operating maneuvering propeller, also called a bow thruster, and preferably is placed at the propeller base area opposite to the propeller area, where corrosion protection effect is greatest.

Structure 5 has a cup-like peripheral edge retaining anode 1, and anode 1 has a corresponding engaging profile for engaging said peripheral edge of structure 5. In one embodiment, retainer 201 is provided at said peripheral edge of structure 5. Advantageously, this embodiment provides for anode 1 to be retained in place even when wear level is high, and to maintain electrical contact with structure 5, providing for optimum functionality. Therefore, the replacement of anode 1 is advantageously and considerably simple and fast, because it is sufficient to remove retainer 101 (in this example, unscrew a screw) centrally placed on anode 1, to remove the non-worn or non-corroded portion of anode 1, and to replace it with a new anode 1, which is retained in place not only by the fastener 101, but also by the annular retainer 201.

Figure 5:
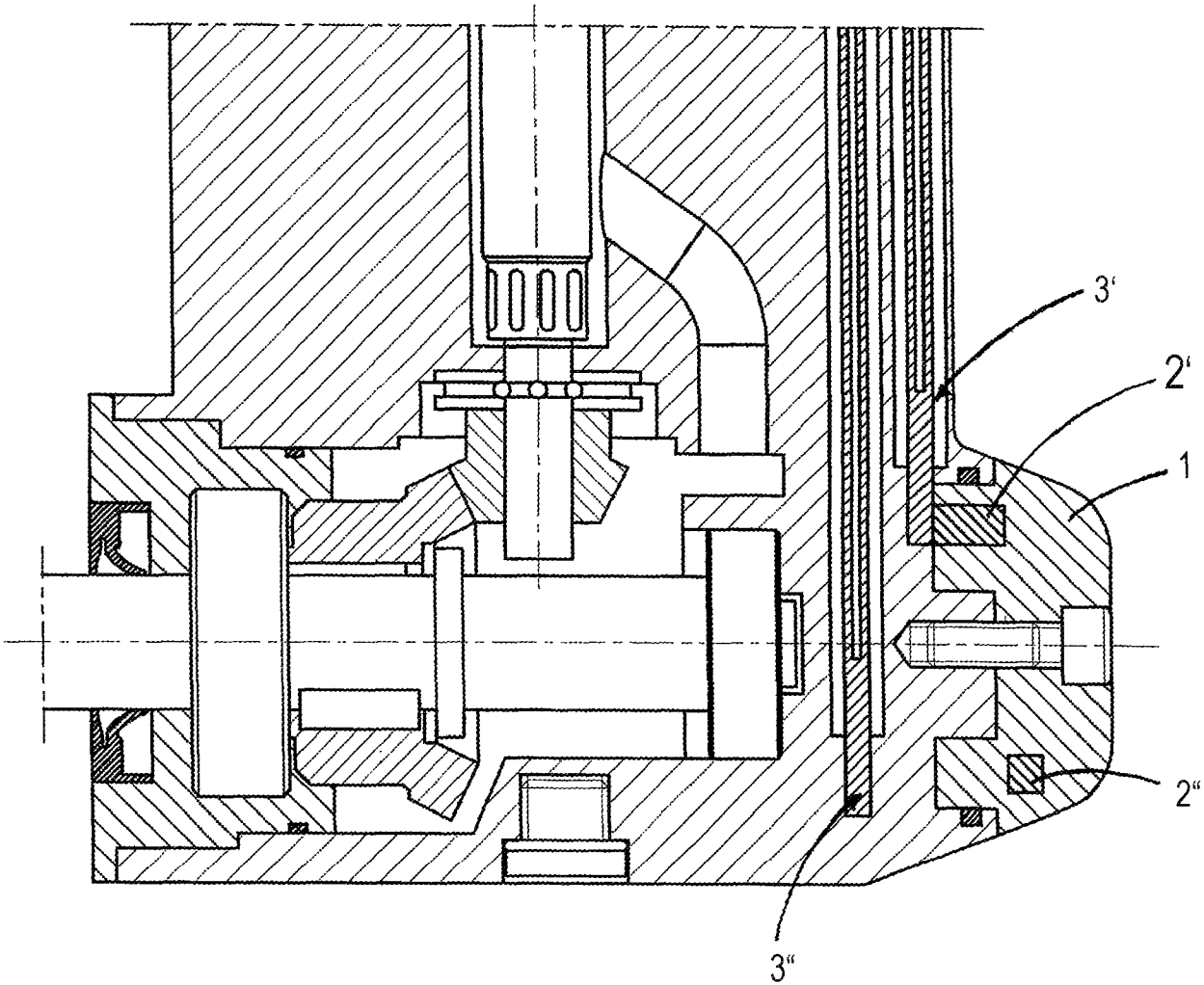
FIG. 5 is a device according to an embodiment of the present invention having two magnets.

According to a variant of the embodiment shown in FIG. 5, two, three or more first portions 2 of said device may be provided, whose presence or absence is verified by at least a second portion 3 and/or by a second portion 3 for each first device portion 2 associated thereto.

In essence, a single second portion 3 may monitor the presence of all or a part of the first portions 2, or the presence or absence of each first portion 2 may be monitored by the corresponding second portion 2.

More particularly FIG. 5 shows a device having two first portions 2' and 2", or magnets in one embodiment, and two second device portions 3' and 3", or magnetic detectors, which detectors 3' and 3" detect each the presence/absence of the corresponding magnet 2', 2"

In this configuration, magnet 2" is released before magnet 2', i.e. when anode 1 is worn to such an extent that the recess of magnet 2" is outwardly open, as described above, and so the detection circuit 3" detects the absence of magnet 2" when it is outwardly released and indicates that situation to the user in order to create a first warning signal. In this event, the wear of anode 1 can be monitored with respect to different erosion or wear or corrosion thresholds thereof, corresponding to the presence of various magnets 2 inserted inside anode 1.

Second device portion 3, once the absence of first device portion 2 has been verified, produces a signal and/or a control, which signal and/or control is transferred to a user interface for indicating that situation to the user.

Preferably, the control or signal directed from second device portion 3 to the user interface is transmitted by cable, for example via a BUS, BUS CAN connection or the like, causing the device according to the present invention to be implemented easily in boats already provided with this type of connection. Such type of connection is well suitable to be used with a device, in which first and the second portions 2 and 3 are manufactured according to Bluetooth technology as described above.

What is claimed is:

1. A cathodic protection device with sacrificial anode comprising:

a sacrificial anode configured to wear out due to corrosion, the sacrificial anode being electrically connected to a structure to be protected against the corrosion; and an indication device configured to detect the wear of the sacrificial anode wirelessly, wherein the indication device comprises a first indication device portion removably coupled to the sacrificial anode and a second indication device portion fixed with respect to the sacrificial anode, wherein the first indication device portion is releasable from the sacrificial anode at a predetermined wear level of the sacrificial anode, and wherein the predetermined wear level is detected by the second indication device portion by monitoring presence or absence of the first indication device portion.

2. The device according to claim 1, wherein the monitoring of the presence or absence of the first indication device portion is performed by the second indication device portion by a wireless connection of the magnetic or radiofrequency type.

3. The device according to claim 1, wherein the monitoring of the presence or absence of the first indication device portion is performed by the second indication device portion by a wireless connection comprising a READ relay.

4. The device according to claim 1, wherein the first indication device portion comprises a magnetic unit removal housed in a recess in the anode, and wherein the second indication device portion comprises a detection circuit that includes a READ relay.

5. The device according to claim 4, wherein the housing recess is an entirely closed recess when the wear or corrosion of the anode is lower than the predetermined level, and wherein the housing recess becomes open to the outer environment when the wear of the anode exceeds the predetermined level.

6. The device according to claim 1, further comprising a fastener for fastening the sacrificial anode to the structure.

7. The device according to claim 6, wherein the fastener is a screw placed in a substantially intermediate position with respect to the anode.

8. The device according to claim 6, wherein the fastener is a peripheral retainer for engaging the anode by interference fit.

9. The device according to claim 8, wherein the retainer is manufactured from an electrically conductive material.

10. The device according to claim 8, wherein the retainer is shaped like an annular member extending at least along a peripheral engaging edge of the anode.

11. The device according to claim 1, wherein the second indication device portion employs a Hall Effect to verify the presence or absence of the first device portion.

12. The device according to claim 1, wherein the second indication device portion, once the absence of the first device portion has been verified, produces a signal transferred to a user interface for indicating the absence to a user.

13. The device according to claim 12, wherein the signal from the second indication device portion to the user interface is transmitted by cable.

14. The device according to claim 13, wherein the cable transmission of the signal from the second indication device portion is transmitted by a BUS or BUS CAN connection.

15. The device according to claim 1, wherein the sacrificial anode is placed at a base of a transverse operating maneuvering propeller.

16. The device according to claim 15, wherein the anode is placed at the base of the maneuvering propeller in a propeller base area opposite to a propeller area.

17. The device according to claim 1, wherein there is provided a plurality of first indication device portions, and wherein the presence or absence of the plurality of first indication device portions is verified by the second indication device portion.

18. The device according to claim 17, wherein the presence or absence of the plurality of first indication device portions is verified by one second indication device portion for each the first indication device portions.

19. The device according to claim 17, wherein the plurality of the first indication device portions is arranged to detect different wear levels of the anode

20. The device according to claim 19, wherein the different wear levels are detected by the first and second indication device portions and are transmitted to a user interface indicating the wear level of the anode to a user.

21. The device according to claim 1, wherein the structure has a peripheral edge retaining the anode, wherein the anode has a correspondingly engaging profile for engaging the peripheral edge of the structure, and wherein a retainer is provided at the peripheral edge of the structure.

22. The device according to claim 1, wherein at least one of the first or second indication device portions comprises a radiofrequency transmission chip.

23. The device according to claim 1, wherein at least one of the first or second indication device portions is configured with Bluetooth technology.

24. The device according to claim 1, wherein at least one of the first or said second indication device portions is configured with ZIG-BEE technology.

25. The device according to claim 1, wherein at least one of the first or second indication device portions is configured with a proprietary wireless standard.

* * * * *